US009560457B2

(12) United States Patent
Toda

(10) Patent No.: US 9,560,457 B2
(45) Date of Patent: Jan. 31, 2017

(54) PLUG CONNECTOR

(71) Applicant: Yamaha Corporation, Hamamatsu-shi, Shizuoka (JP)

(72) Inventor: Akihiko Toda, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 42 days.

(21) Appl. No.: 14/465,044

(22) Filed: Aug. 21, 2014

(65) Prior Publication Data

US 2015/0055793 A1 Feb. 26, 2015

(30) Foreign Application Priority Data

Aug. 22, 2013 (JP) ..... 2013-172627

(51) Int. Cl.
*H04R 1/10* (2006.01)
*H04R 25/00* (2006.01)

(52) U.S. Cl.
CPC ..... *H04R 25/556* (2013.01); *H04R 2420/03* (2013.01)

(58) Field of Classification Search
CPC ... H04R 2420/03; H04R 2420/05; H04R 1/04; H04R 1/06; H04R 1/08; H04R 2420/01; H04R 2499/11; H04R 29/00; H04R 3/00; H04R 5/04; H04R 1/1041; H04R 2201/107; H04R 2420/09; H04R 25/502
USPC ..... 381/74, 56–58, 123, 370; 340/533
See application file for complete search history.

(56) References Cited

U.S. PATENT DOCUMENTS

2008/0164994 A1* 7/2008 Johnson ..... H01R 13/703 340/533
2013/0108064 A1* 5/2013 Kocalar ..... G01R 31/31857 381/58
2013/0142350 A1* 6/2013 Larsen ..... H04R 1/1041 381/74

FOREIGN PATENT DOCUMENTS

JP 3407622 B2 5/2003
JP 2008-294803 A 12/2008

* cited by examiner

*Primary Examiner* — Lun-See Lao
(74) *Attorney, Agent, or Firm* — Crowell & Moring LLP

(57) ABSTRACT

A plug connector includes: a jack portion into which a pin of a microphone-equipped headphone plug in which a speaker contact portion connected to a speaker of a headphone, a ground contact portion connected to a ground wire of the headphone, and a microphone contact portion connected to a microphone of the headphone are sequentially formed in an axial direction, the jack portion having a first contact which is in contact with the speaker contact portion, a second contact which is in contact with the ground contact portion, and a third contact which is in contact with the microphone contact portion; a bias circuit configured to supply a bias voltage to the third contact through a resistor; and a control circuit configured to detect that the pin is extracted from the jack portion, based on a change of a potential of the third contact.

4 Claims, 6 Drawing Sheets

PLUG CONNECTOR

CROSS-REFERENCE TO RELATED APPLICATION(S)

This application is based upon and claims the benefit of priority from prior Japanese patent application No. 2013-172627, filed on Aug. 22, 2013, the entire contents of which are incorporated herein by reference.

BACKGROUND

The present invention relates to a plug connector which is used in connection with a plug for a headphone combined with a microphone (hereinafter, such a plug is referred to as "microphone-equipped headphone plug") in an audio apparatus, and particularly to a plug connector having a function of detecting insertion/extraction of a plug.

FIG. 9 is a circuit diagram showing the configuration of an audio apparatus including a plug connector 100 of the related art. The plug connector 100 includes a jack portion 110 into which a pin 10 of a microphone-equipped headphone plug 1 is to be inserted.

In the side surface of the pin 10, speaker contact portions 11L, 11R, a ground contact portion 12, and a microphone contact portion 13 are sequentially formed with starting from the tip end of the pin along the direction of insertion into the jack portion 110. Insulating portions 14 are interposed in spaces between the contact portions 11L, 11R, 12, 1312 respectively. Here, the speaker contact portions 11L, 11R are connected to L- and R-channel speakers of a headphone, respectively. The ground contact portion 12 is connected to ground terminals of the speakers and microphone of the headphone. The microphone contact portion 13 is connected to the microphone of the headphone.

The jack portion 110 has spring contacts 111, 112, 113, 114. In a state where the pin 10 is inserted in the jack portion 110, the contacts 111, 112, 113, 114 are in contact with the contact portions 11L, 11R, 12, 13 of the pin 10, respectively. The contact 111 cooperates with a contact 115 to constitute a mechanical switch 116.

A headphone semiconductor integrated circuit 200 generates an audio signal which is to be supplied to the headphone connected to the plug connector 100, and receives and processes an audio signal which is to be supplied from the headphone. In FIG. 9, among components constituting the headphone semiconductor integrated circuit 200, only components related to the function of the plug connector 100 are illustrated. As shown in FIG. 9, the headphone semiconductor integrated circuit 200 has control circuits 201, 202, potential detectors 211, 212, speaker amplifiers 220L, 220R, a microphone amplifier 230, and a bias circuit 240. The headphone semiconductor integrated circuit 200 further has terminals DETIN, HPOUTL, HPOUTR, MICIN, MICDET, MICBIAS.

The contact 115 of the jack portion 110 is connected to the terminal DETIN, and connected also to a power supply VCC through a resistor R1. The contact 111 is connected to the terminal HPOUTL, and grounded through a resistor R2. The contact 112 is connected to the terminal HPOUTR. The contact 113 is grounded. The contact 114 is connected to the terminal MICIN through a capacitor C. The contact 114 is further connected to the terminal MICDET, and also to the terminal MICBIAS through a resistor R3.

In the headphone semiconductor integrated circuit 200, the speaker amplifiers 220L, 220R are circuits which output signals for driving the two or L- and R-channel speakers of the headphone connected to the microphone-equipped headphone plug 1, from the terminals HPOUTL, HPOUTR, respectively. The microphone amplifier 230 amplifies an input signal which is supplied through the terminal MICIN. The bias circuit 240 outputs a bias voltage which is to be applied to the microphone of the headphone connected the microphone-equipped headphone plug 1. The potential detector 211 is a circuit for detecting whether the potential of the terminal DETIN is equal to or higher than a predetermined threshold or not. The control circuit 201 detects insertion/extraction of the pin 10 of the microphone-equipped headphone plug 1 into/from the jack portion 110, based on the result of the detection of the potential detector 211, and controls various portions based on a result of the insertion/extraction detection. The potential detector 212 is a circuit for detecting whether the potential of the terminal MICDET is lower than a predetermined threshold or not. Based on a result of the detection of the potential detector 212, the control circuit 202 determines whether the headphone is equipped with a microphone or not, or whether a switch which is connected in parallel to the microphone of the microphone-equipped headphone is turned ON/OFF.

FIG. 9 shows a state where the pin 10 of the microphone-equipped headphone plug 1 is inserted in the jack portion 110. In the state, the contact 111 is separated from the contact 115 by the speaker contact portion 11L at the tip end of the pin 10, so that the mechanical switch 116 is turned OFF and the power supply voltage VCC is applied to the terminal DETIN. In this case, the potential detector 211 detects that the potential of the terminal DETIN is higher than the threshold. As a result, the control circuit 201 deems that the pin 10 is inserted in the jack portion 110, and applies the power supply voltage to circuits such as the speaker amplifiers 220L, 220R, the microphone amplifier 230, and the bias circuit 240, thereby causing the circuits to operate.

FIG. 10 shows a state where the pin 10 of the microphone-equipped headphone plug 1 is extracted from the jack portion 110. In the state, the pin 10 is separated from the contact 111, and therefore the contact 111 butts against the contact 115, so that the mechanical switch 116 is turned ON and a voltage which is obtained by dividing the power supply voltage VCC with the resistors R1, R2 is applied to the terminal DETIN. In this case, the potential detector 211 detects that the potential of the terminal DETIN is lower than the threshold. As a result, the control circuit 201 deems that the pin 10 is extracted from the jack portion 110, and controls circuits such as the speaker amplifiers 220L, 220R, the microphone amplifier 230, and the bias circuit 240 so as to stop their operations.

Techniques for detecting insertion/extraction of a plug of this kind are disclosed in, for example, Japanese Patent No. 3,407,622 and JP-A-2008-294803.

In the above-described plug connector 100 of the related art, the mechanical switch 116 is required for detecting insertion/extraction of the pin 10, and hence there is a problem in that the plug connector cannot be applied to a jack portion not having the mechanical switch 116.

The plug connector 100 of the related art has a further problem in that there is a case where, during the process of extracting the pin 10 of the microphone-equipped headphone plug 1 from the jack portion 110, a noise is emitted from the speakers of the headphone. Hereinafter, the problem will be described with reference to FIG. 11.

FIG. 11 exemplarily shows a state where the pin 10 is slightly extracted from the jack portion 110, and the contact 114 is in contact with the ground contact portion 12. In FIG. 11, wirings interposed between the contact portions 13, 12, 11R, 11L, and the microphone M, ground wire, left and right speakers SPL, SPR of the headphone (mainly wiring in cables connecting the microphone-equipped headphone plug 1 with the headphone speakers and the microphone M) are indicated by broken lines. In the example, in the state where the contact 114 is in contact with the ground contact portion 12, the speaker contact portion 11L at the tip end of the pin 10 remains to butt against the contact 111, the contact 111 is separated from the contact 115, and the mechanical switch 116 is turned OFF. Depending on the configuration of the jack portion 110, such a state may occur when the plug 1 is extracted.

In this state, since the mechanical switch 116 is turned OFF, the power supply voltage VCC is applied to the terminal DETIN. Therefore, the control circuit 201 continues to allow circuits such as the speaker amplifiers 220L, 220R, the microphone amplifier 230, and the bias circuit 240 to operate. Consequently, a current flows from the output terminal of the bias circuit 240 into the ground contact portion 12 through the resistor R3. A part of the current which flows into the ground contact portion 12 flows to the speaker SPR of the headphone through wirings interposed between the ground contact portion 12 and the speaker SPR, and then flows from the speaker SPR into the ground wire through the speaker contact portion 11R and the contact 113. The remaining part of the current which flows into the ground contact portion 12 flows to the speaker SPL of the headphone through wirings interposed between the ground contact portion 12 and the speaker SPL, and then flows from the speaker SPL into the speaker contact portion 11L. The current which flows into the speaker contact portion 11L thereafter flows into the output terminal of the speaker amplifier 220R through the contact 112 and the terminal HPOUTR, or flows into the output terminal of the speaker amplifier 220L through the contact 111 and the terminal HPOUTL, or flows from the contact 111 into the ground wire through the resistor R2.

When the pin 10 is further extracted from the jack portion 110, thereafter, the speaker contact portion 11L at the tip end of the pin 10 is separated from the contact 111, and the mechanical switch 116 is turned ON. This causes the control circuit 201 to stop the operation of the bias circuit 240. As a result, the current output from the output terminal of the bias circuit 240 is interrupted, and also the current supply to the speakers SPL, SPR is cut off.

As described above, the plug connector 100 of the related art has the problem in that, during the process of extracting the pin 10 from the jack portion 110, a pulsed current flows to the speakers SPL, SPR of the headphone, and a noise is sometimes emitted from the speakers.

SUMMARY

The invention has been conducted in view of the above-discussed circumstances. It is a first object of the invention to provide a plug connector which can be applied also to a jack portion not having a mechanical switch. It is a second object of the invention to provide a plug connector in which, during a process of extracting a pin of a microphone-equipped headphone plug from a jack portion, it is possible to prevent a noise from being emitted from a speaker of a headphone.

According to an aspect of the invention, there is provided a plug connector comprising: a jack portion into which a pin of a microphone-equipped headphone plug in which a speaker contact portion connected to a speaker of a headphone, a ground contact portion connected to a ground wire of the headphone, and a microphone contact portion connected to a microphone of the headphone are sequentially formed in an axial direction with starting from a tip end of the pin while insulating portions are interposed respectively between the contact portions is to be inserted, the jack portion having a first contact which is in contact with the speaker contact portion, a second contact which is in contact with the ground contact portion, and a third contact which is in contact with the microphone contact portion, in a state where the pin is inserted in the jack portion; a bias circuit which is configured to supply a bias voltage to the third contact through a resistor; and a control circuit which is configured to detect that the pin is extracted from the jack portion, based on a change of a potential of the third contact.

When the control circuit detects that the pin is extracted from the jack portion, the control circuit may cause the bias circuit to stop an output of the bias voltage.

The jack portion may include a switch in which, when the tip end of the pin is separated from the first contact, ON/OFF states are switched, and the control circuit may detect that the pin is extracted from the jack portion, based on switching of the ON/OFF states of the switch, or the change of the potential of the third contact.

When, during a process of extracting the pin from the jack portion, the control circuit detects that the third contact makes contact with the insulating portion interposed between the microphone contact portion and the ground contact portion, the control circuit may cause the bias circuit to stop an output of the bias voltage.

The control circuit may perform a control of supplying periodically and intermittently an electric power to the bias circuit and a circuit which detects the potential of the third contact, and, in a case where the pin is extracted from the jack portion, supply the electric power to the bias circuit and the circuit which detects the potential of the third contact, with a cycle length that is longer than in a case where the pin is inserted in the jack portion.

According to an aspect of the invention, there is also provided a plug connector comprising: a jack portion into which a pin of a microphone-equipped headphone plug in which a speaker contact portion connected to a speaker of a headphone, a ground contact portion connected to a ground wire of the headphone, and a microphone contact portion connected to a microphone of the headphone are sequentially formed in an axial direction with starting from a tip end of the pin while insulating portions are interposed respectively between the contact portions is to be inserted, the jack portion having a first contact which is in contact with the speaker contact portion, a second contact which is in contact with the ground contact portion, and a third contact which is in contact with the microphone contact portion, in a state where the pin is inserted in the jack portion; a bias circuit which is configured to supply a bias voltage to the third contact through a resistor; and a control circuit which, when detecting that the pin is extracted from the jack portion, based on a change of a potential of the third contact, causes the bias circuit to stop an output of the bias voltage.

The control circuit may detect that the pin is extracted from the jack portion, based on that a phenomenon that the potential of the third contact is higher than a predetermined threshold is detected.

DETAILED DESCRIPTION OF EXEMPLARY EMBODIMENTS

Hereinafter, embodiments of the invention will be described with reference to the drawings.

First Embodiment

Figure 1:
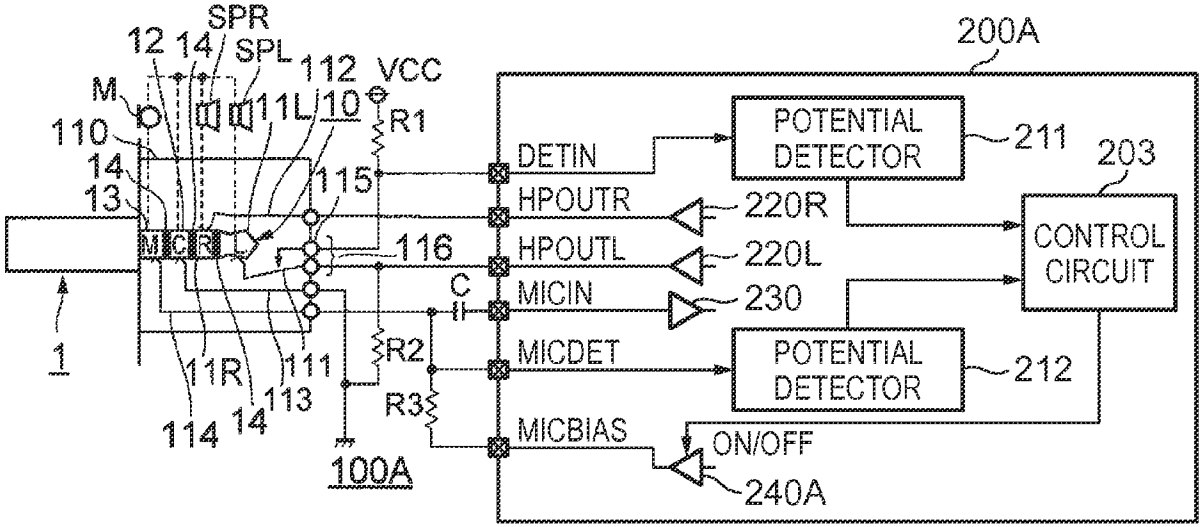
FIG. 1 is a circuit diagram showing the configuration of an audio apparatus including a plug connector of a first embodiment of the invention.

FIG. 1 is a circuit diagram showing the configuration of a plug connector 100A of a first embodiment of the invention. The plug connector 100A includes a jack portion 110 into which a pin 10 of a microphone-equipped headphone plug 1 is to be inserted.

In the side surface of the pin 10, speaker contact portions 11L, 11R, a ground contact portion 12, and a microphone contact portion 13 are sequentially formed with starting from the tip end of the pin along the direction of insertion into the jack portion 110. Insulating portions 14 are interposed in spaces between the contact portions 11L, 11R, 12, 13, respectively. Here, the speaker contact portions 11L, 11R are connected to L- and R-channel speakers of the headphone, respectively. The ground contact portion 12 is connected to ground terminals of the speakers and microphone of the headphone. The microphone contact portion 13 is connected to the microphone of the headphone.

The jack portion 110 has spring contacts 111, 112, 113, 114. In a state where the pin 10 is inserted in the jack portion 110, the contacts 111, 112, 113, 114 are in contact with the contact portions 11L, 11R, 12, 13 of the pin 10, respectively. The contact 111 cooperates with a contact 115 to constitute a mechanical switch 116.

A headphone semiconductor integrated circuit 200A generates an audio signal which is to be supplied to the headphone connected to the plug connector 100A, and receives and processes an audio signal which is to be supplied from the headphone. The headphone semiconductor integrated circuit 200A has terminals DETIN, HPOUTL, HPOUTR, MICIN, MICDET, MICBIAS. The contact 115 of the jack portion 110 is connected to the terminal DETIN, and connected also to a power supply VCC through a resistor R1. The contact 111 is connected to the terminal HPOUTL, and grounded through a resistor R2. The contact 112 is connected to the terminal HPOUTR. The contact 113 is grounded. The contact 114 is connected to the terminal MICIN through a capacitor C. The contact 114 is further connected to the terminal MICDET, and also to the terminal MICBIAS through a resistor R3. The headphone semiconductor integrated circuit 200A has potential detectors 211, 212, speaker amplifiers 220L, 220R, and a microphone amplifier 230, and also a bias circuit 240A, and a control circuit 203. The speaker amplifiers 220L, 220R are circuits which output signals for driving the two or L- and R-channel speakers of the headphone connected to the microphone-equipped headphone plug 1, from the terminals HPOUTL, HPOUTR, respectively. The microphone amplifier 230 amplifies an input signal which is supplied through the terminal MICIN. The potential detector 211 is a circuit for detecting whether the potential of the terminal DETIN is equal to or higher than a predetermined threshold or not. The potential detector 212 is a circuit for detecting whether the potential of the terminal MICDET is lower than a predetermined threshold or not.

The bias circuit 240A outputs a bias voltage which is to be applied to the microphone of the headphone connected the microphone-equipped headphone plug 1. The output terminal of the bias circuit 240A is connected to the terminal MICBIAS. In accordance with a control signal supplied from the control circuit 203, the bias circuit 240A outputs a bias voltage to the terminal MICBIAS (ON), or stops the output of the bias voltage (OFF).

When the potential detector 211 detects that the voltage of the terminal DETIN is higher than the predetermined threshold th1, and the potential detector 212 detects that the voltage of the terminal MICDET is lower than the predetermined threshold th2, the control circuit 203 causes the bias circuit 240A to output the bias voltage. Here, the threshold th1 is an intermediate voltage between a voltage which is obtained by dividing the power supply voltage VCC with the resistors R1, R2, and the power supply voltage VCC. The threshold th2 is an intermediate voltage between a voltage which is obtained by dividing the bias voltage of the terminal MICBIAS with the resistor R3 and the internal resistance of the microphone M, and the bias voltage.

By contrast, when the potential detector 211 detects that the voltage of the terminal DETIN is lower than the threshold th1, or the potential detector 212 detects that the voltage of the terminal MICDET is higher than the threshold th2, the control circuit 203 causes the bias circuit 240A to stop the output of the bias voltage. This is a feature of the embodiment.

Next, the operation of the embodiment will be described. FIG. 1 shows a state where the pin 10 of the microphone-equipped headphone plug 1 is inserted in the jack portion 110. In FIG. 1, wirings interposed between the contact portions 13, 12, 11R, 11L, and the microphone M of the headphone, ground wires, and the left and right speakers SPL, SPR are indicated by the broken lines. As shown in FIG. 1, in the state where the pin 10 of the microphone-equipped headphone plug 1 is inserted in the jack portion 110, the speaker contact portion 11L at the tip end of the pin 10 butts against the contact 111 to separate the contact 111 from the contact 115, and the mechanical switch 116 is turned OFF, so that the power supply voltage VCC is applied to the terminal DETIN. In this case, the potential detector 211 detects that the voltage of the terminal DETIN is higher than the threshold th1. In the state where the pin 10 is inserted in the jack portion 110, moreover, the contact 114 is in contact with the microphone contact portion 13. Therefore, the voltage of the terminal MICDET is obtained by dividing the bias voltage of the terminal MICBIAS with the resistor R3 and the internal resistance of the microphone M. In this case, the potential detector 212 detects that the voltage of the terminal MICDET is lower than the threshold th2. In this state, the control circuit 203 continues to cause the bias circuit 240A to output the bias voltage.

Figure 2:
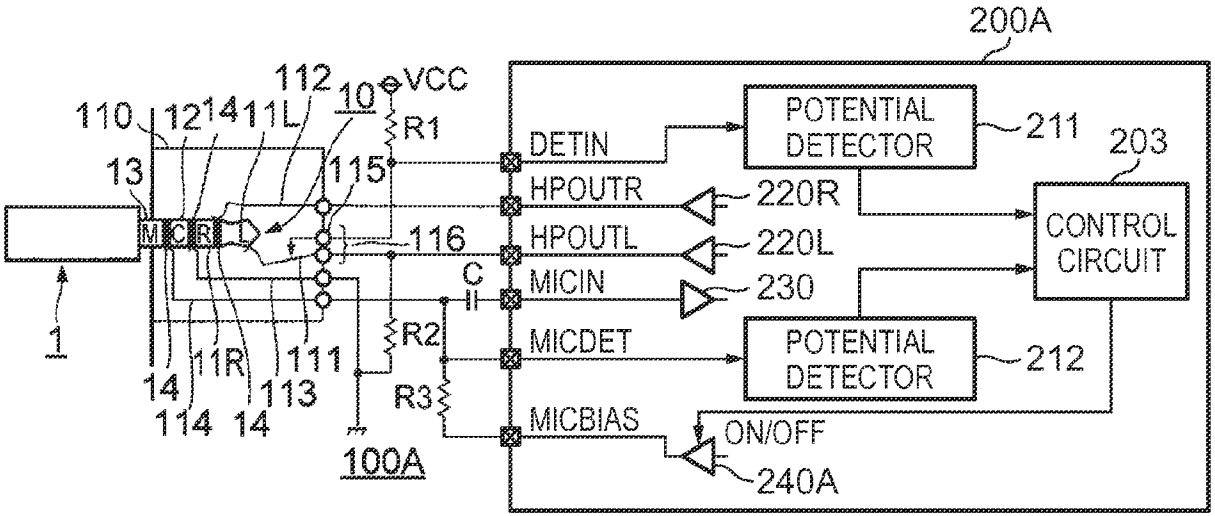
FIG. 2 is a circuit diagram showing states of various portions at a timing when a pin of a microphone-equipped headphone plug in the embodiment begins to be extracted from a jack portion, and a third contact makes contact with an insulating portion between a microphone contact portion and a ground contact portion.

When the pin 10 of the microphone-equipped headphone plug 1 begins to be extracted from the jack portion 110, as shown in FIG. 2, the microphone contact portion 13 is separated from the contact 114, and the insulating portion 14 makes contact with the contact 114. In the example shown in FIG. 2, at this timing, the speaker contact portion 11L of the pin 10 remains to be in contact with the contact 111, and the mechanical switch 116 is turned OFF. Since the insulating portion 14 makes contact with the contact 114, however, the voltage of the terminal MICDET exceeds the threshold th2, and then rises to the bias voltage of the terminal MICBIAS. As a result, the potential detector 212 detects that the voltage of the terminal MICDET becomes higher than the threshold th2. Therefore, the control circuit 203 deems that the pin 10 is extracted from the jack portion 110, and causes the bias circuit 240A to stop the output of the bias voltage.

Figure 3:
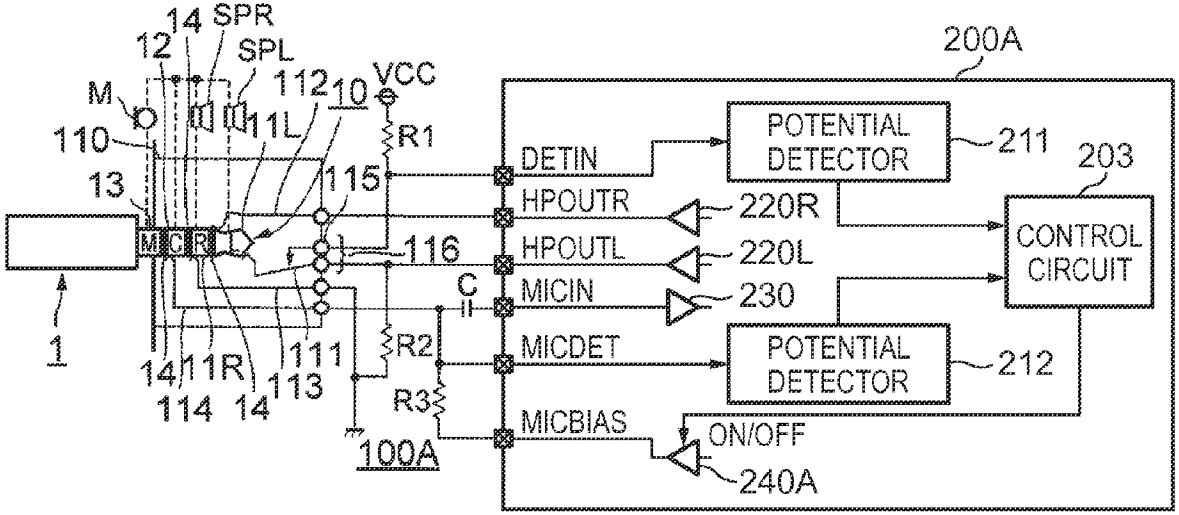
FIG. 3 is a circuit diagram showing states of various portions at a timing when the pin of the microphone-equipped headphone plug in the embodiment is further extracted from the jack portion, and the third contact makes contact with the ground contact portion.

When the pin 10 of the microphone-equipped headphone plug 1 is further extracted from the jack portion 110, as shown in FIG. 3, the insulating portion 14 is separated from the contact 114, and the ground contact portion 12 makes contact with the contact 114. As a result, the terminal MICBIAS is connected to the ground contact portion 12 through the resistor R3. At this timing, however, the bias circuit 240A is stopping the output of the bias voltage. Therefore, the current flow into the ground contact portion 12 through the resistor R3 does not occur. In the example shown in FIG. 3, also at this timing, the speaker contact portion 11L of the pin 10 remains to be in contact with the contact 111, and the mechanical switch 116 is turned OFF.

Figure 4:
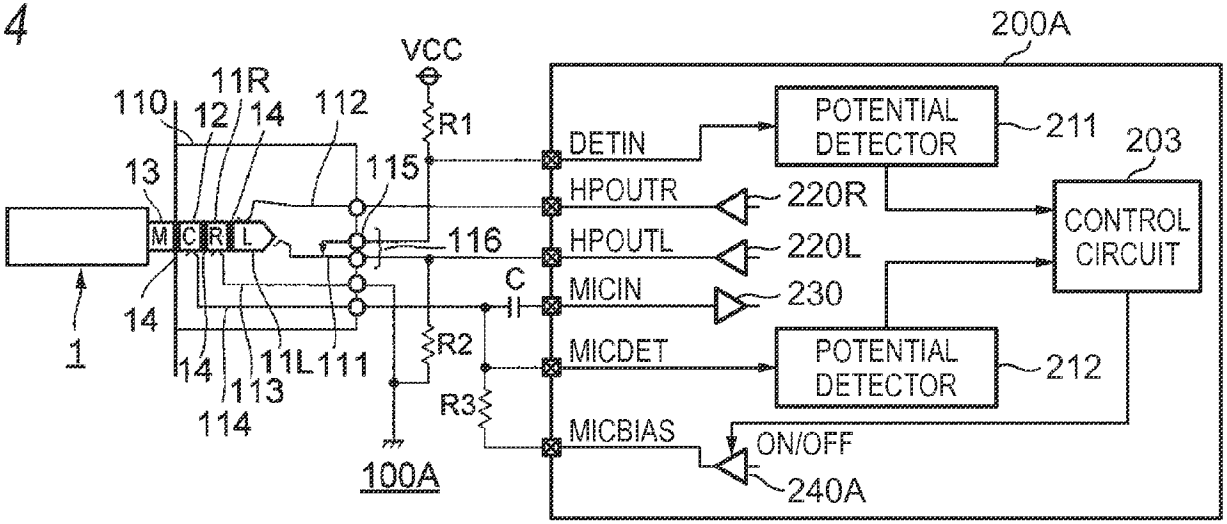
FIG. 4 is a circuit diagram showing states of various portions at a timing when the pin of the microphone-equipped headphone plug in the embodiment is further extracted from the jack portion, and a first contact is separated from the speaker contact portions.

When the pin 10 of the microphone-equipped headphone plug 1 is further extracted from the jack portion 110, as shown in FIG. 4, the speaker contact portion 11L is separated from the contact 111 in the state where the ground contact portion 12 is in contact with the contact 114, the contact 111 makes contact with the contact 115, and the mechanical switch 116 is turned ON.

In the embodiment, as described above, even in the case where, during the process of extracting the pin 10 of the microphone-equipped headphone plug 1 from the jack portion 110, the ground contact portion 12 makes contact with the contact 114 before the mechanical switch 116 is turned ON, the insulating portion 14 makes contact with the contact 114 before the ground contact portion 12 makes contact with the contact 114. At this time, the voltage of the terminal MICDET rises to the level of the bias voltage. Then, the potential detector 212 detects the potential rise of the terminal MICDET, and the control circuit 203 stops the output of the bias voltage from the bias circuit 240A. Even when the contact 114 connected to the output terminal of the bias circuit 240A thereafter makes contact with any one of the contact portions 12, 11R, 11L, therefore, the current flow from the output terminal of the bias circuit 240A into the contact portion does not occur. During the process of extracting the pin 10 of the microphone-equipped headphone plug 1 from the jack portion 110, consequently, a noise is not emitted from the speakers SPL, SPR.

Figure 5:
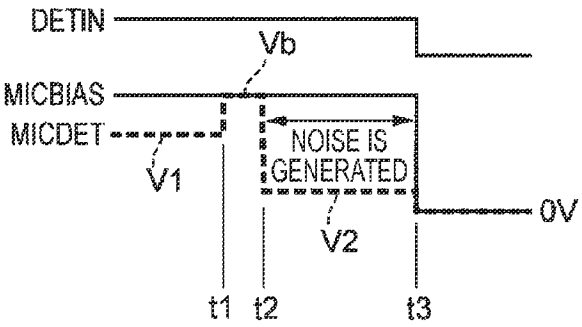
FIGS. 5(*a*) and 5(*b*) are time charts showing potential waveforms of various portions in a period when the pin of the microphone-equipped headphone plug in the embodiment is inserted into the jack portion, and that when the pin is being extracted from the jack portion.
Figure 5:
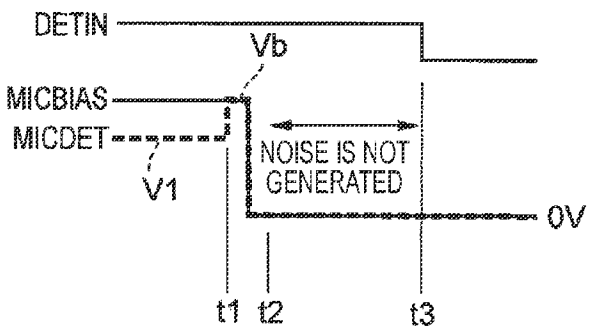
Figure 9:
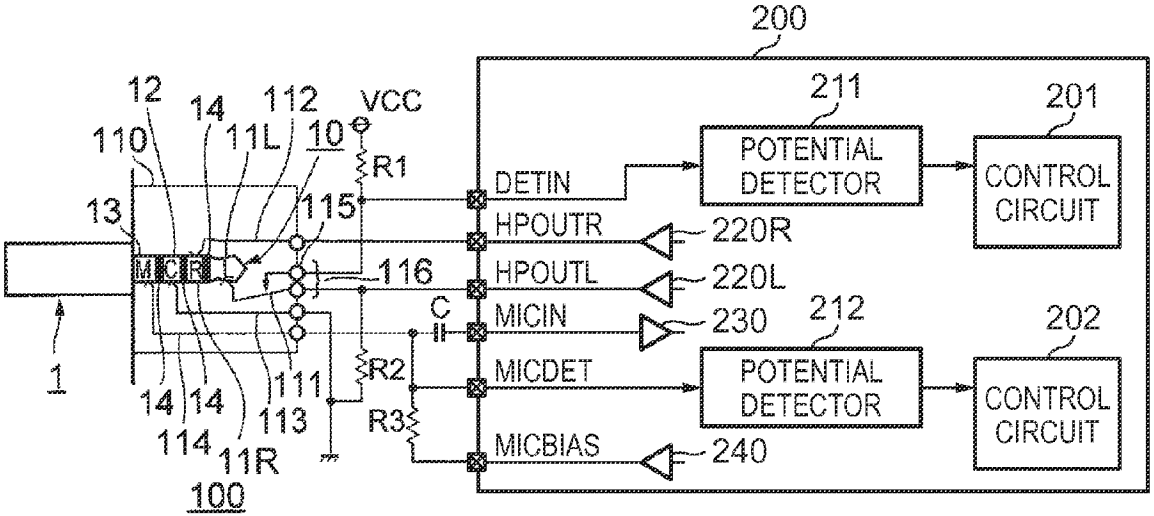
FIG. 9 is a circuit diagram showing the configuration of an audio apparatus including a plug connector of the related art.
Figure 10:
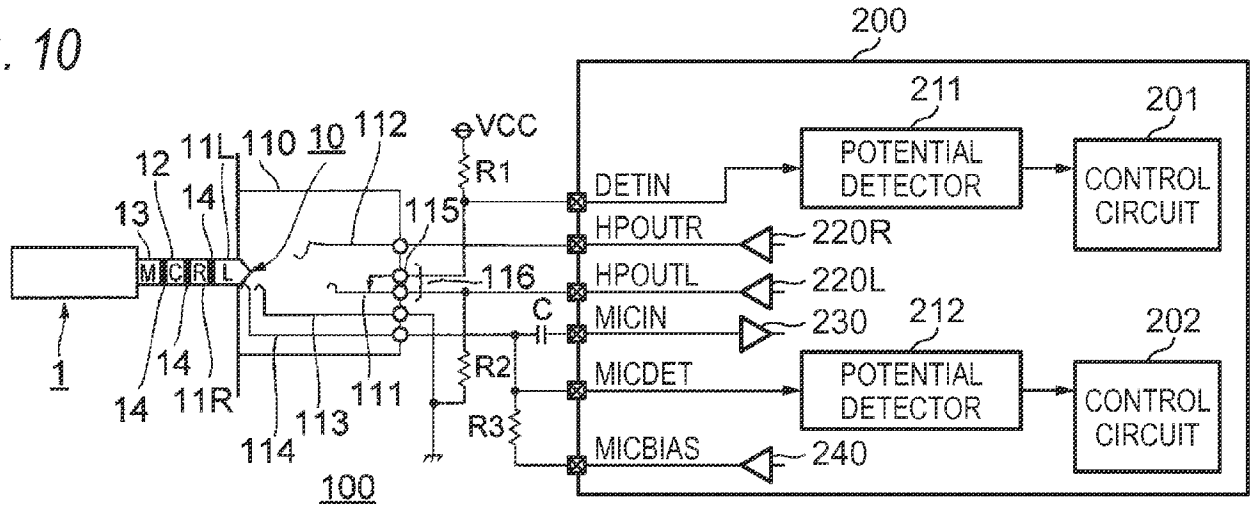
FIG. 10 is a circuit diagram showing states of various portions when a pin of a microphone-equipped headphone plug in the plug connector is extracted from a jack portion.
Figure 11:
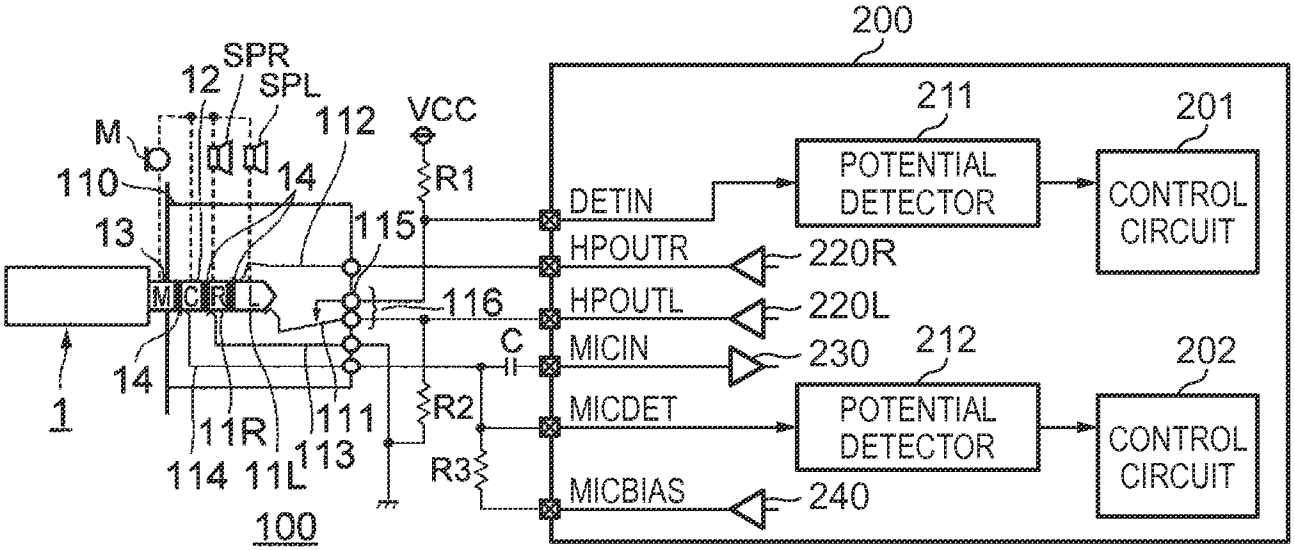
FIG. 11 is a circuit diagram showing states of various portions at a timing when a noise is emitted from speakers of the microphone-equipped headphone plug in the plug connector.

FIGS. 5(*a*) and 5(*b*) show an effect of the embodiment in contrast to the related art. FIG. 5(*a*) is a time chart showing potential waveforms of the terminals DETIN, MICBIAS, MICDET during the process of extracting the pin 10 of the microphone-equipped headphone plug 1 from the jack portion 110, in the above-described configuration of FIG. 9. FIG. 5(*b*) is a time chart showing potential waveforms of the terminals DETIN, MICBIAS, MICDET during the process of extracting the pin 10 of the microphone-equipped headphone plug 1 from the jack portion 110, in the embodiment (FIG. 1). In FIGS. 5(*a*) and 5(*b*), t1 indicates the time when the contact 114 is separated from the microphone contact portion 13 and makes contact with the insulating portion 14, t2 indicates the time when the contact 114 is separated from the insulating portion 14 and makes contact with the ground contact portion 12, and t3 indicates the time when the mechanical switch 116 is turned ON.

Referring to FIGS. 5(*a*) and 5(*b*), in the state where the pin 10 of the microphone-equipped headphone plug 1 is inserted in the jack portion 110, the voltage of the terminal MICDET is a voltage V1 which is obtained by dividing the bias voltage Vb with the resistor R3 and the internal resistance of the microphone M, and the mechanical switch 116 is turned OFF. Therefore, the voltage of the terminal DETIN is the power supply voltage VCC.

When, at the time t1, the contact 114 is separated from the microphone contact portion 13 and makes contact with the insulating portion 14, the voltage of the terminal MICDET rises from the voltage V1 to the bias voltage Vb. In the related art, even when the voltage of the terminal MICDET rises from the voltage V1 to the bias voltage Vb, the bias circuit 240 continues to output the bias voltage Vb.

When, at the time t2, the contact 114 is separated from the insulating portion 14 and makes contact with the ground contact portion 12, the speakers SPR, SPL are connected to the contact 114 through the ground contact portion 12. As a result, a current flows from the bias circuit 240 to the ground contact portion 12 through the terminal MICBIAS and the resistor R3, and further into the speakers SPR, SPL. This state continues until the time t3 when the mechanical switch 116 is turned ON. During this state, the voltage of the terminal MICDET is a voltage V2 which is lower than the bias voltage Vb.

When, at the time t3, the speaker contact portion 11L is separated from the contact 111 and the mechanical switch 116 is turned ON, the voltage of the terminal DETIN is the voltage (lower than the threshold th1) which is obtained by dividing the power supply voltage VCC with the resistors R1, R2, and the control circuit 201 (FIG. 9) stops the output of the bias voltage Vb from the bias circuit 240. As a result, the voltages of the terminals MICBIAS, MICDET are 0 V, and a current does not flow from the terminal MICBIAS to the ground contact portion 12.

In the related art, in the case where the pin 10 is extracted from the jack portion 110, as described above, a current flows from the bias circuit 240 to the speakers SPR, SPL during a period from the time t2 when the contact 114 makes contact with the ground contact portion 12, to the time t3 when the mechanical switch 116 is turned ON, and a noise is emitted from the speakers SPR, SPL.

By contrast, in the embodiment, when, at the time t1, the contact 114 is separated from the microphone contact portion 13 and makes contact with the insulating portion 14, and the voltage of the terminal MICDET rises to the bias voltage NVb, the control circuit 203 which detects the voltage rise stops the output of the bias voltage from the bias circuit 240A. This causes the potential of the terminal MICBIAS to be 0 V as shown in FIG. 5(*b*). In the embodiment, therefore, a current does not flow into the speakers SPR, SPL during the process of extracting the pin 10 of the microphone-equipped headphone plug 1 from the jack portion 110, and a noise is not emitted from the speakers SPL, SPR.

In the above, the operation of the embodiment has been described by exemplifying the case where, during the process of extracting the pin 10 of the microphone-equipped headphone plug 1 from the jack portion 110, the ground contact portion 12 makes contact with the contact 114 before the mechanical switch 116 is turned ON. Depending on the structures of the pin 10 of the microphone-equipped headphone plug 1 and the jack portion 110, however, there may be a case where the mechanical switch 116 is turned ON before the ground contact portion 12 makes contact with the contact 114. In the embodiment, when the potential detector 211 detects that the voltage of the terminal DETIN becomes lower than the threshold th1, or when the potential detector 212 detects that the voltage of the terminal MICDET becomes higher than the threshold th2, however, the control circuit 203 causes the bias circuit 240A to stop the output of the bias voltage. In the case where the mechanical switch 116 is turned ON before the ground contact portion 12 makes contact with the contact 114, the voltage of the terminal DETIN becomes lower than the threshold th1 at the timing when the mechanical switch 116 is turned ON, and, at this timing, the control circuit 203 therefore causes the bias circuit 240A to stop the output of the bias voltage. According to the embodiment, even in the situation where the mechanical switch 116 is turned ON before the ground contact portion 12 makes contact with the contact 114, consequently, it is possible to prevent a noise from being emitted from the speakers SPR, SPL.

Second Embodiment

Figure 6:
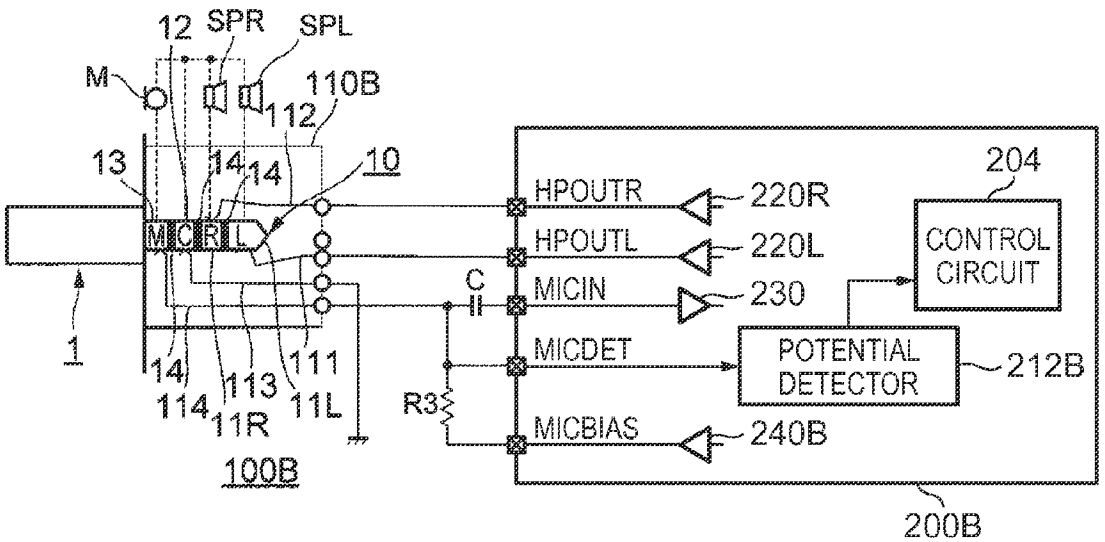
FIG. 6 is a circuit diagram showing the configuration of an audio apparatus including a plug connector of a second embodiment of the invention.

FIG. 6 is a circuit diagram showing the configuration of a plug connector 100B of a second embodiment of the invention. In FIG. 6, the components corresponding to those of FIG. 1 above are denoted by the same reference numerals, and their description is omitted.

In the embodiment, the jack portion 110 in the first embodiment is replaced with a jack portion 110B. In the jack portion 110B, the contact 115 constituting the mechanical switch 116 is not disposed, and the contact 111 is used only for the purpose of being contacted with the speaker contact portion 11L. In the embodiment, moreover, the resistors R1, R2 are not disposed. Furthermore, the headphone semiconductor integrated circuit 200A in FIG. 1 is replaced with a headphone semiconductor integrated circuit 200B. The headphone semiconductor integrated circuit 200B does not have the terminal DETIN and potential detector 211 of the headphone semiconductor integrated circuit 200A. In the headphone semiconductor integrated circuit 200B, the control circuit 203, potential detector 212, and bias circuit 240A of the headphone semiconductor integrated circuit 200A are replaced with a control circuit 204, a potential detector 212B, and a bias circuit 240B.

The control circuit 204 of the headphone semiconductor integrated circuit 200B performs a control of supplying periodically and intermittently an electric power from the power supply VCC to the potential detector 212B and the bias circuit 240B. In the control circuit 204, when an electric power is supplied to the potential detector 212B and the bias circuit 240B, the potential of the contact 114 is detected by the potential detector 212B. When an electric power is supplied to the potential detector 212B and the bias circuit 240B, then, the control circuit 204 determines whether the pin 10 of the microphone-equipped headphone plug 1 is extracted from the jack portion 110B or not, based on a result of the potential detection which is performed on the contact 114 by the potential detector 212B. During a period when the pin 10 of the microphone-equipped headphone plug 1 is extracted from the jack portion 110B, the control circuit 204 repeats the control of supplying an electric power to the potential detector 212B and the bias circuit 240B with a cycle length that is longer than that in a period during which the pin 10 of the microphone-equipped headphone plug 1 is inserted in the jack portion 110B.

Figure 7:
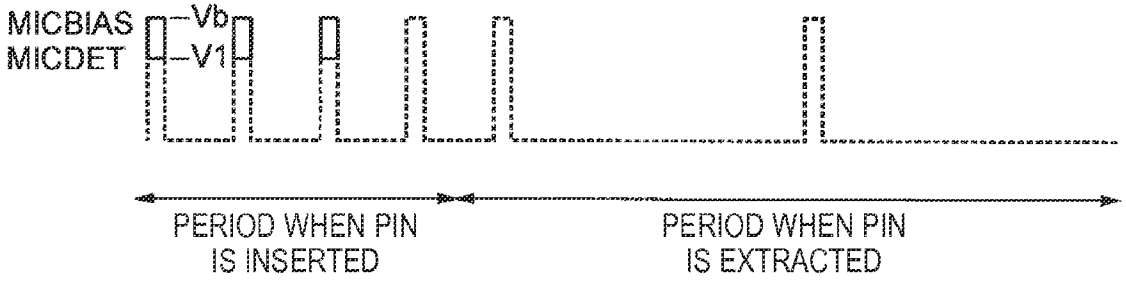
FIG. 7 is a time chart showing potential waveforms of various portions in the embodiment during a process of extracting a pin of a microphone-equipped headphone plug from a jack portion.

FIG. 7 is a time chart showing potential waveforms of the terminals MICBIAS, MICDET during a period when the pin 10 is inserted in the jack portion 110B, and that when the pin is extracted from the jack portion 110B.

During the period when the pin 10 is inserted in the jack portion 110B, under the control of the control circuit 204, the bias circuit 240B outputs periodically and intermittently the bias voltage Vb to the terminal MICBIAS.

In the state where the pin 10 is inserted in the jack portion 110B, the contact 114 is in contact with the microphone contact portion 13, the contact 113 is in contact with the ground contact portion 12, and therefore a voltage V1 which is obtained by dividing the bias voltage Vb of the terminal MICBIAS with the resistor R3 and the internal resistance of the microphone M is applied to the terminal MICDET. In the state where the pin 10 is inserted in the jack portion 110B, therefore, the terminal MICBIAS has periodically and intermittently a voltage of Vb, and, during a period when the voltage of the terminal MICBIAS is Vb, the voltage of the terminal MICDET is V1.

When the pin 10 is extracted from the jack portion 110B, the pin 10 is separated from the contact 114. When the voltage of the terminal MICBIAS is Vb, therefore, the voltage of the terminal MICDET is Vb. Therefore, the potential detector 212B detects that the potential of the terminal MICDET becomes higher than the threshold th2, and the control circuit 204 detects that the pin 10 is extracted from the jack portion 110B.

When it is detected that the pin 10 is extracted from the jack portion 110B, the control circuit 204 sets the cycle length with which an electric power is intermittently supplied to the potential detector 212B and the bias circuit 240B, to be longer than that in the case where the pin 10 is inserted in the jack portion 110B.

Also in the state where the pin 10 is extracted from the jack portion 110B, the control circuit 204 monitors the result of the potential detection of the potential detector 212B when the voltage of the terminal MICBIAS is Vb. In the case where the potential detector 212B detects that the potential of the terminal MICDET becomes lower than the threshold th2, the control circuit 204 detects that the pin 10 is inserted into the jack portion 110B.

As described above, according to the embodiment, even in the case where the jack portion 110B does not have a mechanical switch, it is possible to detect insertion/extraction of the pin 10. According to the embodiment, since an electric power is supplied periodically and intermittently from the power supply VCC to the potential detector 212B and the bias circuit 240B, moreover, the power consumption of the plug connector 100B can be suppressed to a low level. According to the embodiment, in the case where the pin 10 is extracted from the jack portion 110B, furthermore, the cycle length with which an electric power is supplied to the potential detector 212B and the bias circuit 240B is made longer than the case where the pin 10 is inserted in the jack portion 110. Therefore, the power consumption of the plug connector 100B can be further suppressed.

Other Embodiments

Figure 8:
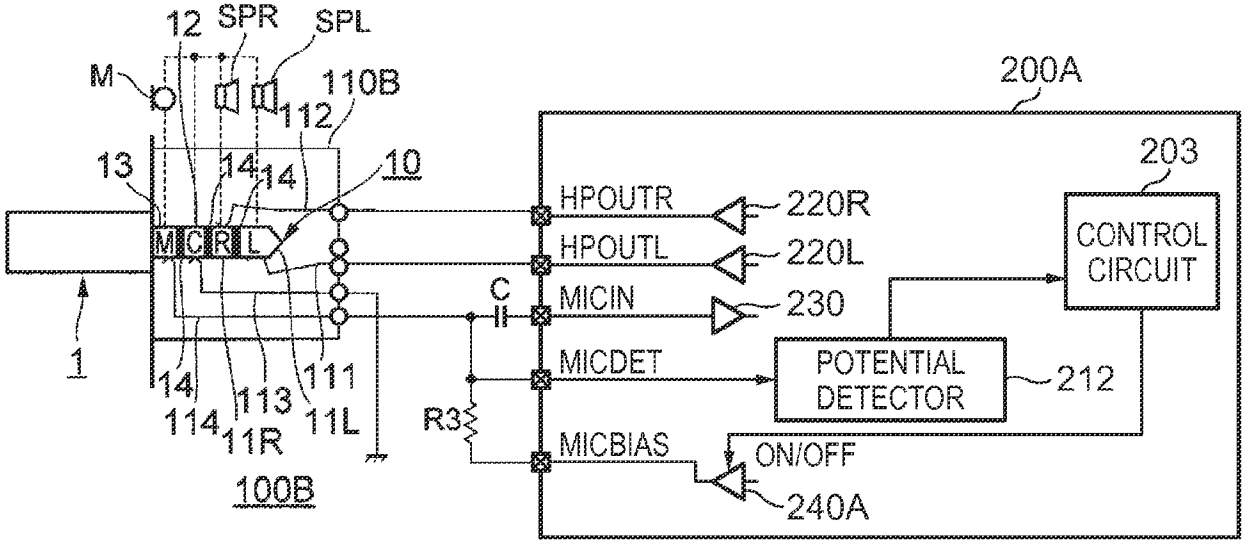
FIG. 8 is a circuit diagram showing the configuration of an audio apparatus including a plug connector of another embodiment of the invention.

Although the embodiments of the invention have been described, other embodiments of the invention may be contemplated. In the first embodiment above, the control circuit 203 can detect that the pin 10 is extracted from the jack portion 110, based on a result of the potential detection which is performed on the terminal MICDET by the potential detector 212. Therefore, the first embodiment may be applied to the jack portion 110B which is not provided with a mechanical switch as in the second embodiment (FIG. 8). In this case, the headphone semiconductor integrated circuit 200A may be configured so that the potential detector 211 is omitted, and the control circuit 203 detects insertion/extraction of the pin 10, based only on a result of the potential detection which is performed on the terminal MICDET by the potential detector 212.

Although, in the embodiments, the invention has been described by taking as an example the microphone-equipped headphone plug 1 which is to be used in a stereo headphone having L- and R-channel speakers, the invention may be applied also to a monaural headphone. In this case, the plurality of components disposed for stereo sound reproduction, such as the L- and R-channel speakers, and the speaker contact portions 11L, 11R of the pin 10 are formed as components singly disposed for monaural sound reproduction.

Furthermore, "headphone" in the specification includes not only headphones having a shape in which speakers are put respectively on the ears, but also those having a shape in which speakers are inserted respectively into the ears (so-called, earphones).

According to an aspect of the invention, there is provided a plug connector including: a jack portion into which a pin of a microphone-equipped headphone plug in which a speaker contact portion connected to a speaker of a headphone, a ground contact portion connected to a ground wire of the headphone, and a microphone contact portion connected to a microphone of the headphone are sequentially formed in an axial direction with starting from a tip end of the pin while insulating portions are interposed respectively between the contact portions is to be inserted, the jack portion having a first contact which is in contact with the speaker contact portion, a second contact which is in contact with the ground contact portion, and a third contact which is in contact with the microphone contact portion, in a state where the pin is inserted in the jack portion; a bias circuit which is configured to supply a bias voltage to the third contact through a resistor; and a control circuit which is configured to detect that the pin is extracted from the jack portion, based on a change of a potential of the third contact.

According to an aspect of the invention, it is possible to detect extraction of the pin from the jack portion based on a change of the potential of the third contact. Therefore, the plug connector can be applied also to a jack portion not having a mechanical switch.

In the plug connector, when it is detected that the pin is extracted from the jack portion, moreover, the control circuit causes the bias circuit to stop the output of the bias voltage.

According to an aspect of the invention, when the pin is extracted from the jack portion, the third contact makes contact with the insulating portion before the third contact makes contact with the ground contact portion, and the control circuit detects that the pin is extracted from the jack portion, based on a potential change of the third contact at this time. Before the third contact makes contact with the ground contact portion, therefore, it is possible to stop the supply of the bias voltage to the microphone through the third contact. During the process of extracting the pin from the jack portion, therefore, it is possible to prevent a noise from being emitted from the speaker of the headphone.

According to an aspect of the invention, there is also provided a plug connector comprising: a jack portion into which a pin of a microphone-equipped headphone plug in which a speaker contact portion connected to a speaker of a headphone, a ground contact portion connected to a ground wire of the headphone, and a microphone contact portion connected to a microphone of the headphone are sequentially formed in an axial direction with starting from a tip end of the pin while insulating portions are interposed respectively between the contact portions is to be inserted, the jack portion having a first contact which is in contact with the speaker contact portion, a second contact which is in contact with the ground contact portion, and a third contact which is in contact with the microphone contact portion, in a state where the pin is inserted in the jack portion; a bias circuit which is configured to supply a bias voltage to the third contact through a resistor; and a control circuit which, when detecting that the pin is extracted from the jack portion, based on a change of a potential of the third contact, causes the bias circuit to stop an output of the bias voltage.

What is claimed is:

1. A plug connector, comprising:

a jack portion into which a pin of a microphone-equipped headphone plug, in which one or more speaker contact portions connected to one or more speakers, respectively, of a headphone, a ground contact portion connected to a ground wire of the headphone, and a microphone contact portion connected to a microphone of the headphone are sequentially formed in an axial direction starting from a tip end of the pin while insulating portions are interposed respectively between the contact portions, is to be inserted, the jack portion having one or more first contacts respectively in contact with the one or more speaker contact portions, a second contact which is in contact with the ground contact portion, and a third contact which is in contact with the microphone contact portion, in a state where the pin is inserted in the jack portion, the jack portion including a switch in which, when the tip end of the pin is separated from one of the one or more first contacts, ON/OFF states are switched;

a bias circuit which is configured to supply a bias voltage to the third contact through a resistor; and a control circuit which is configured to detect that the pin is extracted from the jack portion when detecting a change of a potential of the third contact before the ON/OFF states of the switch are switched, the control circuit being further configured to detect that the pin is extracted from the jack portion when detecting switching of the ON/OFF states of the switch before the potential of the third contact is changed, wherein, when the control circuit detects that the pin is extracted from the jack portion, the control circuit causes the bias circuit to stop an output of the bias voltage, and wherein, when, during a process of extracting the pin from the jack portion, the control circuit detects that the third contact makes contact with the insulating portion interposed between the microphone contact portion and the ground contact portion, the control circuit causes the bias circuit to stop the output of the bias voltage.

2. The plug connection according to claim 1, wherein the two speaker contact portions are provided comprising a left speaker contact portion and a right speaker contact portion.

3. A plug connector, comprising:

a jack portion into which a pin of a microphone-equipped headphone plug, in which one or more speaker contact portions connected to one or more speakers, respectively, of a headphone, a ground contact portion connected to a ground wire of the headphone, and a microphone contact portion connected to a microphone of the headphone are sequentially formed in an axial direction starting from a tip end of the pin while insulating portions are interposed respectively between the contact portions, is to be inserted, the jack portion having one or more first contacts respectively in contact with the one or more speaker contact portions, a second contact which is in contact with the ground contact portion, and a third contact which is in contact with the microphone contact portion, in a state where the pin is inserted in the jack portion;

a bias circuit which is configured to supply a bias voltage to the third contact through a resistor; and a control circuit which is configured to detect that the pin is extracted from the jack portion, based on a change of a potential of the third contact, wherein the control circuit performs a control of supplying periodically and intermittently an electric power to the bias circuit and a circuit which detects the potential of the third contact, and, in a case where the pin is extracted from the jack portion, supplies the electric power to the bias circuit and the circuit which detects the potential of the third contact, with a cycle length that is longer than in a case where the pin is inserted in the jack portion.

4. The plug connection according to claim 3, wherein the two speaker contact portions are provided comprising a left speaker contact portion and a right speaker contact portion.

* * * * *